US007686919B2

(12) United States Patent
Snekkenes et al.

(10) Patent No.: US 7,686,919 B2
(45) Date of Patent: Mar. 30, 2010

(54) METHOD AND DEVICE FOR THE CONTINUOUS COOKING OF PULP

(75) Inventors: Vidar Snekkenes, Karlstad (SE); Mikael Lindstrom, Lidingo (SE)

(73) Assignee: Metso Fiber Karlstad AB, Karlstad (SE)

( * ) Notice: Subject to any disclaimer, the term of this patent is extended or adjusted under 35 U.S.C. 154(b) by 254 days.

(21) Appl. No.: 11/817,380

(22) PCT Filed: Nov. 24, 2006

(86) PCT No.: PCT/SE2006/050507

§ 371 (c)(1),
(2), (4) Date: Aug. 29, 2007

(87) PCT Pub. No.: WO2007/064293

PCT Pub. Date: Jun. 7, 2007

(65) Prior Publication Data

US 2008/0202712 A1 Aug. 28, 2008

(30) Foreign Application Priority Data

Nov. 29, 2005 (SE) ..... 0502626

(51) Int. Cl.
*D21C 3/26* (2006.01)

(52) U.S. Cl. ..... 162/19; 162/37; 162/39; 162/45; 162/237

(58) Field of Classification Search ..... 162/19, 162/237, 39, 45, 37, 34, 47
See application file for complete search history.

(56) References Cited

U.S. PATENT DOCUMENTS

| | | | | |
|---|---|---|---|---|
| 2,876,098 | A | 3/1959 | Schandroch | |
| 3,354,029 | A | 11/1967 | Hartler | |
| 3,475,271 | A | 10/1969 | Laakso | |
| 3,617,431 | A | 11/1971 | Croon | |
| 5,885,414 | A * | 3/1999 | Lindstrom et al. | 162/19 |
| 6,241,851 | B1 | 6/2001 | Marcoccia | |
| 2004/0261960 | A1 | 12/2004 | Gustavsson | |

FOREIGN PATENT DOCUMENTS

| | | |
|---|---|---|
| EP | 1115943 | 9/2003 |
| SE | 520956 | 9/2003 |

* cited by examiner

*Primary Examiner*—Mark Halpern
(74) *Attorney, Agent, or Firm*—Rolf Fasth; Fasth Law Offices

(57) ABSTRACT

The continuous digester system has an inlet defined therein for the feed of a chips suspension and an outlet for the output of a cooked suspension of pulp. The suspension or chips is fed in to the inlet through a line at the beginning of the cook, where the chips suspension has a volume of starting cooking fluid that establishes a fluid/wood ratio that is greater than 3.5. A final cooking fluid is present during the cook for the major part of the cook and is withdrawn through a withdrawal strainer only during the final 15 minutes of the cook. The final cooking fluid ensures a fluid/wood ratio that is greater than 3.5 in association with the withdrawal. The withdrawn final cooking fluid during the final 15 minutes of the cook consists of spent black liquor that maintains a residual alkali level that lies under 15 g/l.

6 Claims, 2 Drawing Sheets

FIG. 1 *Prior Art*

METHOD AND DEVICE FOR THE CONTINUOUS COOKING OF PULP

PRIOR APPLICATION

Claiming priority from Swedish Patent Application No. 05026265, filed 29 Nov. 2005. This application is a 371 of PCT/SE2006/050507 filed 24 Nov. 2006

TECHNICAL AREA

The present invention concerns a method for the continuous cooking of chemical cellulose pulp and an arrangement for the continuous cooking of chemical cellulose pulp.

BACKGROUND AND SUMMARY OF THE INVENTION

A number of methods have been developed for the continuous cooking of wood chips in order to improve in different ways the quality of the pulp with respect to, for example, tear strength, beatability, tensile strength, etc. Many of these methods have focused in different ways on controlling the concentration of alkali in the digester in order in this way to influence the process of delignification. It has in addition been discovered that in order to obtain an even pulp quality it is of great importance that the alkali profile across the cross-section of the digester is maintained as even as possible, and that the alkali profile is even and is not too high during the various phases of the cook.

Various suggestions for the adjustment of the alkali during the cook have been used in order to even out the alkali profile during the cook. It is possible, for example, to use adjustment flows, in which a volume of cooking fluid is withdrawn from the digester and returned to the digester after adjustment of the alkali, or where withdrawn cooking fluid that is returned to the digester is replaced fully or partially by dilution fluid, which primarily gives a reduction in what are known as "DOMs" (an acronym for "dissolved organic materials"), where DOM is principally constituted by hemicellulose and lignin, but also of cellulose and other extracted substances from the wood chips. The withdrawal of cooking fluid at several positions and the subsequent replacement of the withdrawn cooking fluid by another fluid, however, involves a reduction in the yield, since residual fibres and hemicellulose disappear with the withdrawn cooking fluid.

FIG. 1 shows different cooking technologies for continuous digesters introduced during the years 1957, 1962, 1983, 1991, 1993, 1997 together with a later patented variant known as "Xylan". Strainer sections are shown as dashed sections with withdrawals to recovery plants/REC (a broad arrow with a solid arrowhead), or in the form of digester flows/Circ, in which fluid is recirculated back to the centre of the digester through conventional central pipes. Heat exchangers/HE are present in certain flow lines. $C_{Liq}$FLOW indicates the direction of flow of the cooking fluid in the digester. The addition of white liquor is shown by WL. In addition to the flows that are shown, there is also, naturally, the addition of dilution fluid at the bottom of the digester, and a top separator in the input to the digester. TC denotes a first digester circulation with heating in which the addition of white liquor can be carried out in addition to that which is added before the digester or at the top of the digester. WC denotes the lower washing flow in which it is heated to a high washing temperature (typically to 120-130° C.) in the systems.

In the very early technology for continuous digesters, all cooking chemicals were added in batches before the cook or at its top, and the cooking fluid was present during the major part of the cook, to be finally withdrawn from the digester through withdrawal strainers arranged at the bottom. This technology was primarily intended for small digesters with a production capacity of a few hundred tonnes of pulp per day, where the digester had a limited diameter of the order of a maximum of 3-4 meters. It was still possible in these small digesters to withdraw sufficiently large volumes of spent cooking fluid from the digester, since it was only 1.5-2 metres in to the centre of the column of chips within the digester, and the speed of the chips was low due to the low production. This type of cooking process is shown schematically in FIG. 1; -57.

The technology in which the digester did not have several strainer sections in the digester, and had only a single strainer section at the bottom, was used also for the cooking of finely chipped slivers, sawdust and one-year plants, where the original material was so finely divided that it was difficult to carry out the withdrawal from the digester since the chipped material was so tightly packed.

In conventional digester technology established during the period 1960-1970 for larger continuous digesters with production capacities of approximately 1000 tonnes of pulp per day, essentially all alkali was added batchwise at the top of the digester with highly located withdrawal strainers in the digester, where a withdrawal REC of spent cooking fluid for the recovery process took place at a time at which the chips had had a retention time of approximately 50-70% of the total retention time in the digester. It was conventional that a zone of countercurrent cooking and washing flow was established under this withdrawal strainer where washing fluid introduced at the bottom was drawn opposite to the flow of the sinking chips. The fluid in this countercurrent cooking and washing zone lies essentially well under the cooking temperature during the principal part of the retention time of the chips in this zone of countercurrent flow. It was normal that there was also a heating flow lowest down in this zone of countercurrent flow (at the beginning of the countercurrent flow) in which the fluid was heated to a temperature that typically lay 10-30° C. under the established cooking temperature in the superior cooking zone. This type of countercurrent washing zone is known also as "Hi-Heat" washing. This type of cooking process is shown schematically in FIG. 1; -62.

The modified continuous cooking technology, MCC, was introduced during the 1980s, as higher requirements for the quality of pulp were desired. The MCC technology means that the alkali is divided into several batches and it is typical that also a small batch of white liquor/WL was added in a flow to even it out arranged under the withdrawal strainer and in the zone of countercurrent flow. It was possible in this manner to obtain a certain evening out of the alkali profile in the cook, and a larger part of the digester was actively used as a cooking zone with an effective level of alkali, which allowed longer cooking times and lower cooking temperatures, which gave better pulp quality, and higher production capacity.

This type of cooking process is shown schematically in FIG. 1; -83 where the MCC flow has been indicated.

A further method to improve the quality of the pulp was developed with the ITC (an abbreviation for "Iso Thermal Cooking") technology, where the highest cooking temperature and the alkali level were reduced relative to the prior art and were maintained at constant levels throughout the cook. This technology meant that washing fluid and cooking fluid added at the bottom of the digester were withdrawn in an extra strainer section and were warmed to full cooking temperature before return to the digester. The time during which the chips were held at full cooking temperature was extended in this manner to be valid for essentially the complete zone of countercurrent flow under the withdrawal section that withdrew spent cooking fluid to the recovery process. This type of cooking process is shown schematically in FIG. 1; -91 where the ITC flow has been indicated.

Very high fluid/wood ratios have begun to be used in pre-impregnation vessels and in the cooking zones of the digester with the aim of further evening out the alkali profile during the cook. This technology constitutes one of the bases of the COMPACT COOKING™ concept developed by Kvaerner Pulping. The alkali concentration in the cooking fluid can in this way be reduced while at the same time the amount of alkali needed for an effective neutralisation process remains in the cooking fluid. Since the fluid fraction per measure of chips is considerably raised, typically with a fluid/wood ratio that lies well over 3.0, it remains possible to guarantee that a sufficient amount of alkali, measured as a quantity of kilograms of alkali per kilogram of wood, is present for the delignification process, while the concentration of alkali at the same time does not need to be so high. As the production is raised to levels greater than 1,800-2,000 tonnes of pulp per day, also the position of the final cooking fluid withdrawal is displaced downwards in the digester, often in combination with several withdrawal positions during the cook. This type of cooking process is shown schematically in FIG. 1; -93, where two withdrawal positions are indicated, and in FIG. 1, -97, where three withdrawal positions are indicated.

Production capacities of 2,500-3,500 tonnes of pulp per day are required in the continuous digesters for chips that are installed now. These continuous digesters are very large with digester diameters of 8-10 metres, and occasionally even larger—around 12 metres in diameter. The problem of implementing withdrawal sections is exacerbated in these digesters, since it becomes more difficult to withdraw cooking fluid from the centre of the column of chips with these strainer sections. The withdrawal sections rapidly reach a limit for the volume of cooking fluid that it is possible to withdraw. One desire, therefore, is to limit the number of strainer sections and to retain the cooking fluid as far as is possible in the digester with a high fluid/wood ratio, according to the COMPACT COOKING™ concept.

It is also known that the yield of pulp is improved by the addition of additives of polysulphide type, as is shown in, for example, U.S. Pat. No. 6,241,851 and U.S. Pat. No. 6,569,851. The effective alkali concentration and the temperature conditions in the first treatment zone are such that essentially no alkali breakdown of the cellulose takes place: instead the material is effectively penetrated by the polysulphide. The material is subsequently treated with an alkali cooking liquor at the cooking temperature in order to produce a chemical cellulose pulp with higher yield from the cooking process than would be achieved if pre-treatment at low temperature, low alkali and in the absence of polysulphide.

Through SE 520 956 is known a method to increase the quality of the pulp with respect to pulp strength, bleachability and reduced subsequent yellowing, while the yield over the digester increases at the same time. This is possible in that all withdrawal fluids, and in particular the hemicellulose-rich impregnation fluid, are allowed an extended retention time outside of the digester before this is returned to the same zone or the immediately subsequent zone. This means that the H factor of the cooking and impregnation fluids increases, i.e. it means that this cooking fluid is given a more extended retention time at the cooking temperature than the retention time that the chips are given. The principle is that a long time is required before the hemicellulose starts to precipitate onto the fibres, which is a process that occasionally takes a retention time for the hemicellulose-rich cooking fluid longer than 60 minutes. It is possible with this technology simply to extend the retention time of the cooking fluid in the system such that this precipitation process can be initiated, something that is appropriate for the cooking systems that do not have sufficient time to activate the precipitation process with the relevant type of wood. It is the intention that as much hemicellulose as possible will be given the opportunity to have time to precipitate onto the fibre, which gives an increased yield of fibre and in certain cases an increase in its strength properties.

It has, however, proved to be the case that the method in SE 520 956 does not give the intended increase of the strength properties of the pulp fibre in all cooking systems or for all types of wood. By increasing the H factor of the impregnation liquor through a retention time that increases the time, it will indeed be the case that more of the hemicellulose that is dissolved from the chips will re-precipitate onto the pulp fibre, but the strength-raising properties of the hemicellulose decrease with the time. The pulp strength of the pulp fibre will for this reason be only slightly increased in several cooking processes. It has, surprisingly, become apparent that what is desired to a larger degree is only to obtain that part of the dissolved hemicellulose that has the longest chains, and it is this fraction of the hemicellulose that precipitates first. If the time in certain cooking systems becomes too long, also those fractions of the hemicellulose with short chain lengths will precipitate, while at the same time the longer chains of hemicellulose that already have been re-precipitated will be broken down.

Another variant for the influence of the precipitation of hemicellulose onto the fibre is revealed in EP, B, 1.115.943. In this variant, cooking fluid that is rich in hemicellulose is withdrawn early in the cook and this cooking fluid with a high content of dissolved hemicellulose is returned to the final phase of the cook. A substantial retention time in the final phase of the cook, greater than 60 minutes, is required in order for the precipitation process to be given sufficient time to be activated. This type of cooking process is shown schematically in FIG. 1, "Xylan", where it is shown that cooking fluid with a high content of hemicellulose is withdrawn early (the second strainer section from the top), and returned to the digester in a cooker flow (the fourth strainer section from the top), where a certain volume of spent cooking fluid can at the same time be withdrawn. This cooking fluid with a high content of hemicellulose can in this manner be reintroduced into the cook, in order to be present during the final phase of the cook, with a duration of at least 60 minutes.

A first aim is to offer an invention that fully or partially solves the disadvantages and problems described above, and to be able effectively to reduce the retention time of the cooking fluid through the complete cook in systems with a far too long retention time of the liquor in the digestion system. The cooking fluid is to be present with the chips in the cooking vessel as long as possible, but the retention time is to be reduced as far as possible.

The principle of the invention is that the level of dissolved hemicellulose is maintained in the cooking fluid throughout the cook, which hemicellulose is dissolved very early in the cook, typically within the first 20-30 minutes of the cook. The process for re-precipitation of hemicellulose requires a long retention time in order to note a measurable effect in raising the yield, typically a retention time of at least 50-70 minutes is required.

A second aim of the invention is to offer a method and an arrangement for continuous cooking that gives a cellulose pulp with optimised and improved pulp quality with respect to the tensile strength, tear strength and beatability of the pulp fibre.

It has proved to be the case that the yield and the strength of the pulp increase with increasing early precipitation of the hemicellulose onto the fibre, but the longer hemicellulose chains are broken down with longer retention times and the strength of the pulp decreases.

A third aim is to maintain the dissolved hemicellulose in the cook and to ensure that it remains right up until the final 15 minutes of the cook, in order to ensure that it has sufficient time to re-precipitate onto the pulp fibre.

A fourth aim of the invention is to reduce specifically the H factor of the cooking fluid, i.e. the time that the cooking fluid is held at the cooking temperature. This means that it is possible actively to control the retention time of the hemicellulose that has been released from the chips in the cook such that it does not have sufficient time to be broken down: it can instead be influenced in a controlled manner such that the original form and structure of the hemicellulose are not changed as a result of breakdown, and it can be precipitated onto the pulp fibre in this form.

A fifth aim is to have a high fluid/wood ratio throughout the complete cook. This entails several advantages since the alkali concentration can be held more even during the cook since a greater amount of kilograms of alkali per kilogram of chips can be established in the cooking fluid, which ensures that the alkali concentration does not fall so greatly during the cooking process as the alkali is consumed as the wood is delignified.

A sixth aim is to implement in modern continuous digesters that have production capacities in the range 2,000-3,000 tonnes, or greater, of pulp per day, where these digestion plants consist of digesters with diameters that easily exceed 6-8 metres, a completely new cooking concept that adopts extremely large strainer sections at the end of the digester where very large volumes of spent cooking fluid are withdrawn, or from the point of view of control, it is attempted to withdraw such volumes. This cooking technique is totally different from other modern cooking techniques for large digestion plants in which several withdrawal positions in the cook are available for several different purposes, and the cook in this way loses the hemicellulose that has been dissolved in the cooking fluid before the final phases of the cook. One aim of the plurality of withdrawals is to maintain low levels of the dissolved DOMs (including hemicellulose) during the cook, but this unavoidably gives losses of the dissolved hemicellulose. Another aim is that limitations have been seen in the withdrawal of cooking fluid from the cook in these large digesters and it is therefore necessary to use several withdrawal positions, and this also removes dissolved hemicellulose from the cook before the final phases of the cook.

A seventh aim is to make it possible to reduce the highest alkali concentration during the cook, typically that which is established at the beginning of the cook, while at the same time retaining a relatively high and even alkali concentration during the complete cook, until the final phases of the cook. The time during which the alkali in the cooking fluid is consumed is reduced through the establishment of a high fluid/wood ratio in the cook and the reduction of the retention time of the cooking fluid in the cook, under the condition that the chips have a pre-determined retention time. If, for example, one and the same alkali charge is used at the beginning of the cook while the retention time of the cooking fluid is reduced, the level of residual alkali in the black liquor withdrawn will increase as a result of the reduction in reaction time. This can be exploited through instead reducing the alkali charge at the beginning of the cook with the aim of maintaining the same level of residual alkali in the black liquor. The high fluid/wood ratio and the reduction in retention time of the cooking fluid work together to reduce the alkali concentration at the beginning of the cook, under the condition that it is still possible to ensure a given level of residual alkali in the withdrawn black liquor and an effective alkali concentration during the complete cook. This allows a better pulp strength since it is known that alkali concentrations during the cook that are too high can have an adverse influence on the strength of the pulp.

The aims described above are achieved with a method in accordance with present invention.

The suggested invention concerns a method and an arrangement that, in combination with continuous cooking of chemical cellulose pulp, is to give a cellulose pulp fibre with high tensile durability, tear strength and beatability.

The strong pulp fibre is achieved through having a maintained high fluid/wood ration throughout the complete cook with essentially the same cooking fluid at the end of the cook as at its beginning. The retention time for the cooking fluid in the digester is in this way reduced, and thus also the H factor of the cooking fluid. The total amount of dissolved hemicellulose is in this way reduced, which hemicellulose precipitates back onto the cellulose pulp fibre and gives the fibre its strength-enhancing properties. However, since the strength-enhancing properties of the hemicellulose are highest at the beginning of the cook and become less with time, the chips will obtain a higher tensile strength, tear strength and beatability than what would have occurred in a cooking process with a higher H factor and longer retention time of the cooking fluid. It is, however, necessary that the major part of the cooking fluid is retained throughout the complete passage through the cook, such that as much as possible of the strength-enhancing properties from the hemicellulose have sufficient time to precipitate out onto the fibre.

Further characteristics and aspects of the invention, and its advantages, are made clear by the attached patent claims and by the detailed description of some embodiments given below.

DETAILED DESCRIPTION

Figure 1:
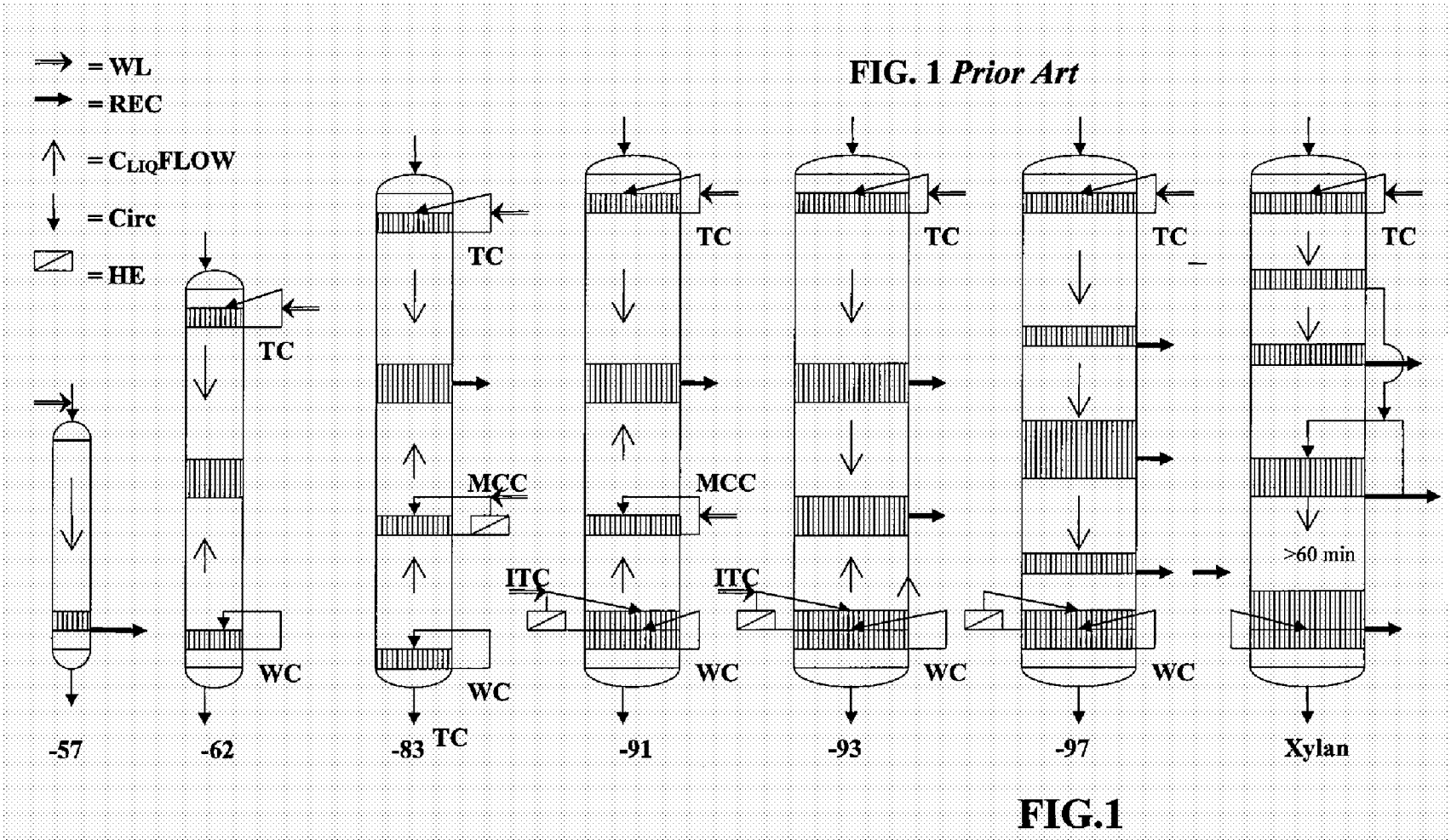
FIG. 1 shows the development steps for continuous cooking from 1957 up to the present.

The concept "suspension of chips" will be used in the following description of the invention. "Suspension of chips" is here used to denote a flow consisting of chips and fluid that is continuously fed into a continuous cooking plant. The fluid in the suspension of chips is principally constituted by condensate, chips moisture, white liquor, washing fluid and black liquor from completed cooking. The term "black liquor from completed cooking" is here used to denote a withdrawal of spent cooking fluid from the digester during the final 15 minutes of the cook, which spent black liquor contains a residual alkali level of less than 15 g/l. The term "the final 15 minutes of the cook" is here used to denote the final 15 minutes of the retention time of the chips in the digester at full cooking temperature and at a time during which the chips are still in the form of a compact column of chips, and in association with the column of chips reaching down to the final withdrawal strainer. It is typical that the retention time for the column of chips at this final strainer section amounts to 30-70 minutes, depending on the total strainer height of the strainer section.

The column of chips reaches under this strainer section a dilution and washing zone in which colder dilution fluid is introduced and drawn upwards towards the strainer section, by which manner a cooling is achieved.

The concept "fluid/wood ratio" will also be used. The term "fluid/wood ratio" is here used to denote the ratio between fluid and wood that is prevalent in the suspension of chips.

In addition, the concepts "starting cooking fluid" and "final cooking fluid" will be used. The term "starting cooking fluid" is here used to denote the volume of fluid in the suspension of chips that establishes a certain fluid/wood ratio at the start of the retention time in the cooking plant. This starting cooking fluid is constituted by one or more fluids consisting of condensate, fresh white liquor, chips moisture, washing filtrate and spent black liquor, which spent black liquor has been present for at least 75% of the total cooking time of the cook. The term "final cooking fluid" is here used to denote a volume of cooking fluid that is a partial volume of the starting cooking fluid, and where this partial volume is present in the cook during the main part of the cook and is first withdrawn during the final 15 minutes of the retention time of the chips in the cook, where the final cooking fluid ensures a fluid/wood ratio that is greater than 3.5. The volume of final cooking fluid is less than or equal to the volume of starting cooking fluid.

Finally, the expressions "withdrawal strainer" and "withdrawal section" will be used. "Withdrawal strainer" is here used to denote an area from which fluid is withdrawn in association with the cook. This area may be either a strainer plate, i.e. a plate with withdrawal slits, or it may be a rod strainer built up of essentially parallel rods with a certain distance between them that establishes the withdrawal slits. A "withdrawal section" may consist of withdrawal strainers arranged over the complete withdrawal section or it may be constructed from a number of withdrawal strainers that cover at least 50% of the total withdrawal section. Full withdrawal capacity can be established with withdrawal strainers arranged in a chessboard pattern known as "staggered screen", with blind plates between the withdrawal strainers, where approximately 50% of the withdrawal section consists of surfaces with withdrawal slits and 50% consists of blind plates. Within the concept "withdrawal section" is also comprised what are known as "filtrate channels" or "headers", which are located by convention under a row of strainers and which have an area without slits facing into the column of chips, the function of which is to collect the withdrawn cooking fluid from the row of strainers that is above it and lead this away from the digester. A withdrawal section, thus, can consist of a number of rows of strainers, with or without blind plates between strainer surfaces in this row, and filtrate channels that lie underneath each row of strainers. Thus several variants of withdrawal sections are possible.

Figure 2:
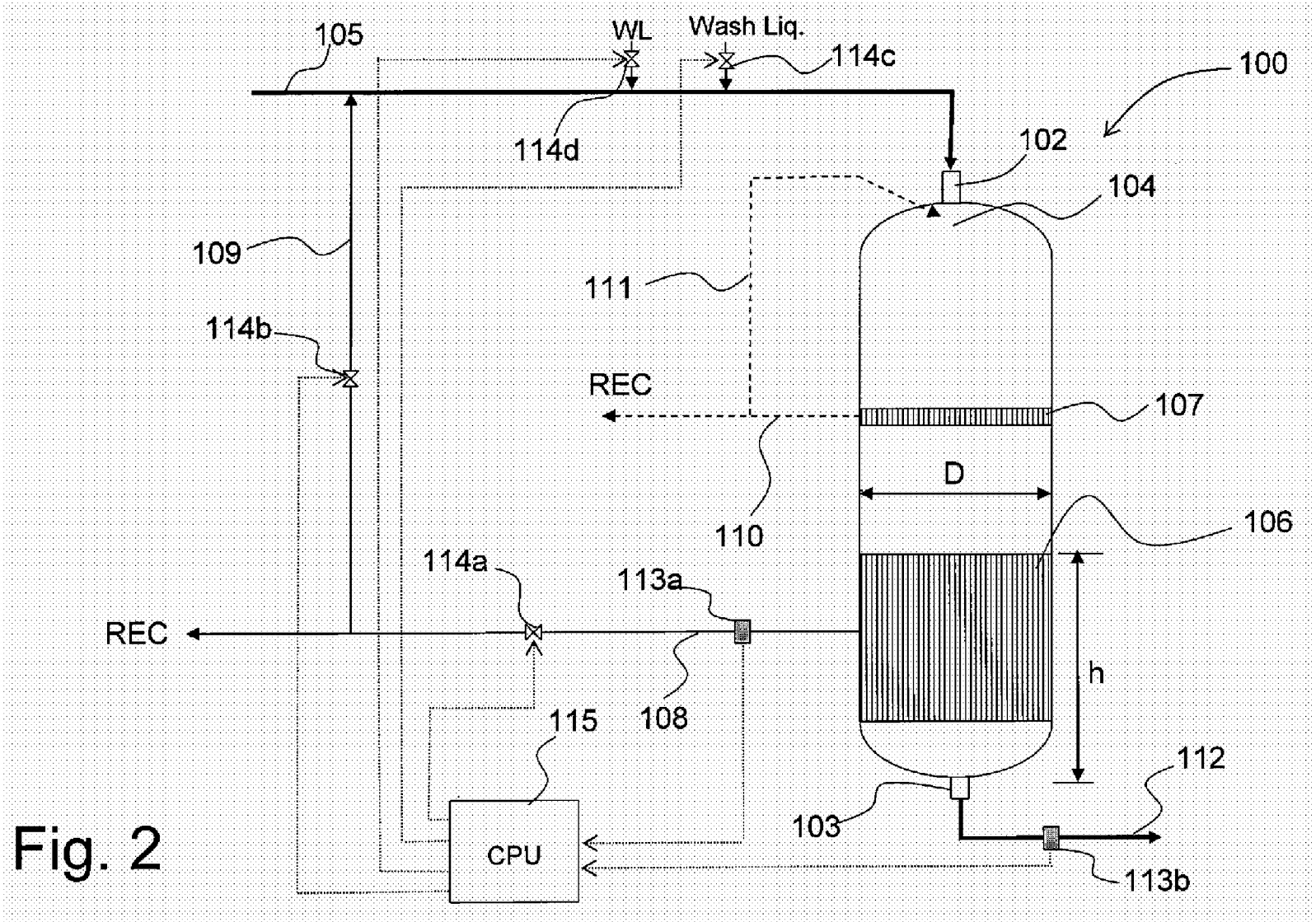
FIG. 2 shows preferred embodiments according to the invention.

FIG. 2 shows a first preferred embodiment of an arrangement according to the invention in which the method is used. The arrangement is used during the continuous cooking of chemical cellulose pulp in a continuous cooking plant 100. The continuous cooking plant 100 shown in FIG. 2 displays a single-vessel system with a digester in which impregnation takes place at the top of the digester. However, two-vessel systems (not shown in the drawing) with a separate impregnation vessel before the digester are possible.

The continuous cooking plant 100 has a line 105 for the feed of a suspension of chips to an inlet 102 at one end of the continuous cooking plant, preferably at its top 101 for the input of the suspension of chips. The cooking plant has also an outlet 103 at its other end, preferably the bottom, for the output of cooked chips in the form of a suspension of pulp to the line 112.

At the start of the cook, i.e. in the upper part 104 of the upper cooking plant the suspension of chips has a volume of starting cooking fluid, which starting cooking fluid establishes a fluid/wood ratio that is greater than 3.5, more preferably greater than 4.0, and most preferably greater than 4.5.

A partial volume of the starting cooking fluid at the beginning of the cook, known as "final cooking fluid", is present in the cook during the major part of the cook and is withdrawn first during the final 15 minutes of the cook through a withdrawal section 106 in which the final cooking fluid ensures a fluid/wood ratio in connection with the withdrawal that is greater than 3.0, preferably greater than 3.5, more preferably greater than 4.0, and most preferably greater than 4.5.

The final cooking fluid that has been withdrawn from the withdrawal strainer 106 consists of spent black liquor, which maintains a level of residual alkali of less than 15 g/l, preferably less than 12 g/l. The volume of final cooking fluid is less than or equal to the volume of starting cooking fluid. The difference in the fluid/wood ratio between the beginning of the cook and the final 15 minutes of the cook can be low, within the interval 0-0.5 units, although larger differences in the fluid/wood ratio can be established in certain circumstances if the volume withdrawn in the withdrawal 110 is large.

Thus, a partial volume of the starting cooking fluid can be withdrawn via one or several withdrawal sections 107 and sent in one or several lines 110 directly of indirectly to the recovery process (REC). A part of this withdrawal from the line 110 can be sent to the beginning of the cook in a line 111.

More than 70%, preferably more than 80% and most preferably more than 90% of the spent black liquor from the withdrawal strainer 106 is sent directly or indirectly to the recovery process (REC) via a line 108. The remaining volume that is not sent to the recovery process can be sent through a line 109 to the suspension of chips before the digester or at the beginning of the cook.

It is an advantage if the digester 101 has a diameter that is greater than 5 metres. The withdrawal section 106 has an area that constitutes more than 70%, preferably more than 80%, of the total withdrawal area of the digester 101. The withdrawal section 106 is located at a height h above the bottom of the digester, where h is less than 2× the diameter D of the digester.

The size of the withdrawal section area measured in square metres depends strictly on the current production of digested pulp from the digester, calculated as tonnes of pulp per day.

Thus, the necessary area of the withdrawal section for various process positions in the digester can be expressed as a relationship according to:

$$\text{Area of withdrawal section}[m^2]=\text{factor } k^*\text{production [tonnes of pulp per day]}.$$

The total withdrawal section 106 at the end of the cook is to have according to the invention a factor k that exceeds 0.06, and that preferably exceeds 0.08. The factor k normally lies within the interval 0.08-0.12.

The following relationships are thus obtained for different levels of production:

| Production (tonnes/day) | Area of withdrawal sections [$m^2$] for factor k = 0.06 | Area of withdrawal sections [$m^2$] for factor k = 0.08 | Typical digester diameter [m] |
|---|---|---|---|
| 1000 | 60 | 80 | 6-8 |
| 1500 | 90 | 120 | |
| 2000 | 120 | 160 | 8-10 |
| 2500 | 150 | 200 | |
| 3000 | 180 | 240 | 10-12 |

The H factor for cooking fluid in the digester will be reduced by having so large fluid/wood ratios throughout the complete digester 101 and a large withdrawal at the end of the cook, since the retention time for the cooking fluid in the digester will be reduced, given that the pulp fed out from the bottom of the digester maintains essentially the same consistency and that the total withdrawal flow from the withdrawal section 106 is increased by a volume that corresponds to the volume returned through the line 109, and given that all other volumes added as batches are maintained essentially equal, except for an adjustment of the ratio of alkali charge to white liquor, in order to adjust the alkali concentration.

The method according to the invention entails that total amount of hemicellulose that is precipitated from the cooking fluid onto the chips is somewhat reduced in extent. However, since the longer chains of the dissolved hemicellulose dominate at the start of the cook and decrease with time as a result of their being broken down, the cooked cellulose pulp will come to have higher tensile strength, tear strength and beatability than those that would have been achieved in a cooking process having a higher H factor and a longer retention time for the cooking fluid in the cook. It is, however, necessary that the major part of the cooking fluid is present throughout the complete cook, such that as much as possible of the strength-enhancing properties from the hemicellulose have sufficient time to be precipitated onto the fibre.

This can be compared with the technology from 1957 (FIG. 1) in which chips and cooking fluid had essentially the same retention time in the digester and thus essentially the same H factor. What was added at the top of the digester was also that which was withdrawn at the bottom. If, for example, a fluid/wood ratio of 2.5 was established at the top of the digester, then the total volume of withdrawn black liquor and output pulp (excluding the dilution fluid added at the bottom) corresponded to essentially the same fluid/wood ratio.

Alternative 1; Reduce the H Factor with Returned Black Liquor

By increasing the volume withdrawn from the withdrawal section 106 by a specified partial volume and returning this given partial volume of spent black liquor to the start of the cook, while maintaining other flows, it is possible to regulate the H factor of the cooking fluid since the speed of the cooking fluid through the digester is in this way increased. The regulation towards a lower H is factor for the cooking fluid specifically entails an increased volume of spent black liquor that is withdrawn from the withdrawal section 106 and returned to the start of the cook, and inversely, a regulation towards higher H factor for the cooking fluid specifically entails a reduced volume of spent black liquor that is withdrawn from the withdrawal section 106 and returned to the start of the cook.

Alternative 2; Decrease the H Factor with an Increased Volume of Washing Filtrate By increasing the volume of added washing filtrate Wash Liq. through 114 with a given partial volume and increasing the volume withdrawn from the withdrawal section 106 by a corresponding partial volume, while maintaining other flows, it is possible to regulate the H factor of the cooking fluid since the speed of the cooking fluid through the digester is in this way increased. The regulation towards a lower H factor for the cooking fluid specifically entails an increased volume of added washing filtrate Wash Liq. and a corresponding volume of spent black liquor that is withdrawn from the withdrawal section 106, and inversely, a regulation towards higher H factor for the cooking fluid specifically entails a reduced volume of added washing filtrate Wash Liq. and corresponding reduced volume of spent black liquor that is withdrawn from the withdrawal section 106.

It is of course possible to carry out a combination of these two alternatives, and these are the regulatory parameters that it is most easy to influence. The volume of condensate that accompanies the chips cannot be influenced in such a simple manner since this volume depends directly on how much direct steam is supplied to the chips for heating.

The volume of white liquor is regulated with the primary aim of maintaining at least one of a certain alkali concentration in the cook and a certain level of residual alkali in the black liquor, and this volume is a secondary regulation that depends on the changed volumes of the fluids.

FIG. 1 shows schematically how it is possible to detect in a suitable manner the properties of the pulp in the blow line 112 with an online sensor 113*b* or with other appropriate sampling means. Detection of the strength properties of the pulp can take place here or of the fraction of precipitated hemicellulose on the cooked fibre, or both of these factors may be detected. It is also possible to detect the fraction of hemicellulose in the withdrawal flow 108 using an appropriate online sensor 113*a* or using corresponding sampling means.

The result from the detection of at least one sensor or sampling means 113*a*/113*b* is used in a control unit 115 to regulate the withdrawal flow through, for example, the valve 114*a* in order to increase or decrease the current regulated partial volume. A corresponding increase or decrease in the partial volume of returned black liquor takes place at the same time, by regulation of the valve 114*b*, or a corresponding increase or decrease in the partial volume of added washing filtrate takes place at the same time, by regulation of the valve 114*c*, or both of these may take place.

EXAMPLE

When applied in a continuous cooking plant that produces 2,000 tonnes of pulp per day and in which 8 $m^3$ of black liquor per tonne of pulp is withdrawn for recovery from the withdrawal section 106, it is possible to reduce the retention time for the cooking fluid by 33% if the withdrawal volume is increased to 10 $m^3$ black liquor per tonne of pulp and to return 2 $m^3$ to the start of the cook, given that the dilution factor is maintained constant at 2.0. The dilution factor means that of a total of 8 $m^3$ that is withdrawn to recovery, 6 $m^3$ is withdrawn from the cooking zone and 2 $m^3$ is withdrawn from the dilution fluid, while in the case in which 10 $m^3$ is withdrawn to recovery then 8 $m^3$ is withdrawn from the cooking zone and 2 $m^3$ from the dilution fluid.

This shows that the H factor of the cooking fluid can be substantially influenced with relatively limited adjustments of the withdrawal volumes. If the retention time is reduced by 33%, the H factor is influenced to a corresponding degree.

Depending on the type of wood being used, deciduous wood/eucalyptus (hardwoods), conifer wood (softwoods), etc., and the cooking process being used, the retention time of the cooking fluid is adjusted in such a manner that precipitation of the hemicellulose is optimised such that it is principally the longer chains of dissolved hemicellulose that are precipitated onto the fibre and do not have sufficient time to be broken down during the cook. If, for example, the sampling of the cooked pulp shows that the pulp strength reaches a given value, then the regulated volumes that influence the retention time can be increased such that the retention time of the cooking fluid decreases. If it can be subsequently shown that the pulp strength increases, it is possible to continue to increase the regulated volumes in steps as long as either the development of the pulp strength is positive or the fraction of hemicellulose precipitated onto the fibre having longer chain structures increases, or both.

The invention is not limited to the embodiments shown here: several variants are possible within the framework of the attached patent claims. It is, of course, possible to implement the invention in a two-vessel digester system in which impregnation, and in certain cases also steam treatment of the chips, take place in a separate first vessel, and where the cooking/impregnation fluid added as a batch in the first vessel accompany the chips during impregnation in the first vessel and the cook in the second vessel. A withdrawal corresponding to the withdrawal 107-110 can instead take place in such two-vessel systems from the withdrawal flow that is obtained from a top separator at the top of the second vessel. A first upper strainer can also be placed in such two-vessel systems at the top of the impregnation vessel, which strainer primarily withdraws condensate and small volumes of black liquor from the impregnation vessel long before the process of impregnation of the chips has started, and for this reason such strainer surfaces are excluded from the percentage figures that concern the size of the withdrawal strainer relative to the other total strainer areas in the impregnation vessel or the digester, or both.

While the present invention has been described in accordance with preferred compositions and embodiments, it is to be understood that certain substitutions and alterations may be made thereto without departing from the spirit and scope of the following claims.

The invention claimed is:

1. A method for the continuous cooking of wood chips for the production of paper pulp in a digester system, comprising:

providing at least one continuous digester, continuously feeding input chips to a top of the digester, forming a suspension of chips at a beginning of a cook, the suspension of chips having a volume of a starting cooking fluid constituted by one or more fluids from condensate, fresh cooking fluid, chips moisture, washing filtrate and spent black liquor, the spent black liquor having been present during at least 75% of a retention time of the cook in the digester, the volume of the starting cooking fluid establishing a fluid/wood ratio that is greater than 3.5, a final cooking fluid, being a partial volume of the starting cooking fluid being present in the cook during a major part of the retention time of the cook, withdrawing the final cooking fluid only during a final 15 minutes of the retention time of the cook, the final cooking fluid ensuring a fluid/wood ratio that is greater than 3.5, the final cooking fluid withdrawn during the last 15 minutes of the retention time of the cook consisting of spent black liquor which maintains a residual alkali concentration of less than 15 g/l, a volume of final cooking fluid being less than the volume of the starting cooking fluid, affecting the volume of the starting cooking fluid to regulate an H factor for hemicellulose, that is present in the cooking fluid and that has been dissolved from the input chips while maintaining a pulp consistency of the cooked pulp, increasing the volume of starting cooking fluid to reduce the H factor for the hemicellulose that is present in the cooking fluid and that has been dissolved from the input chips, decreasing the volume of the starting cooking fluid to increase the H factor for the hemicellulose that is present in the cooking fluid and that has been dissolved from the input chips, affecting the volume of the starting cooking fluid principally through changing a volume of either the washing filtrate or the spent black liquor, and continuously feeding out cooked pulp from a bottom of the digester at the pulp consistency.

2. The method according to claim 1, wherein the starting cooking fluid establishes a fluid/wood ratio that is greater than 4.0 at the beginning of the cook, and the final cooking fluid ensures a fluid/wood ratio during the final 15 minutes of the cook that is greater than 4.0.

3. The method according to claim 1, wherein the starting cooking fluid establishes a fluid/wood ratio that is greater than 4.5 at the beginning of the cook, and the final cooking fluid ensures a fluid/wood ratio, during the final 15 minutes of the retention time of the cook, that is greater than 4.5.

4. The method according to claim 1, wherein at least 75% of the volume of the starting cooking fluid is present in the digester throughout a complete cook.

5. The method according to claim 4, wherein the method further comprises establishing a concurrent cooking zone before a withdrawal of final cooking fluid.

6. The method according to claim 4, wherein the complete cook in the digester takes place in a concurrent cook zone in which both the cooking fluid and the chips move downwardly in the digester.

* * * * *